US011241767B2

(12) United States Patent
Hykes

(10) Patent No.: US 11,241,767 B2
(45) Date of Patent: Feb. 8, 2022

(54) PENDULUM GRINDING MACHINE

(71) Applicant: Fives Landis Corp., Hagerstown, MD (US)

(72) Inventor: Timothy W. Hykes, Greencastle, PA (US)

(73) Assignee: FIVES LANDIS CORP., Hagerstown, MD (US)

( * ) Notice: Subject to any disclaimer, the term of this patent is extended or adjusted under 35 U.S.C. 154(b) by 579 days.

(21) Appl. No.: 15/995,622

(22) Filed: Jun. 1, 2018

(65) Prior Publication Data

US 2019/0366503 A1 Dec. 5, 2019

(51) Int. Cl.

| | |
|---|---|
| ***B24B 27/00*** | (2006.01) |
| ***B24B 41/04*** | (2006.01) |
| ***B24B 41/02*** | (2006.01) |
| ***B24B 5/42*** | (2006.01) |

(52) U.S. Cl.

CPC ..... *B24B 27/0015* (2013.01); *B24B 5/421* (2013.01); *B24B 27/0076* (2013.01); *B24B 41/02* (2013.01); *B24B 41/04* (2013.01); *B24B 5/42* (2013.01); *B24B 5/423* (2013.01); *B24B 27/0046* (2013.01); *B24B 27/0084* (2013.01)

(58) Field of Classification Search

CPC . B24B 27/0015; B24B 5/421; B24B 27/0076; B24B 41/02; B24B 41/04; B24B 5/42; B24B 5/423; B24B 27/0046; B24B 27/0084

USPC ..... 451/178, 236, 242, 249, 251, 280

See application file for complete search history.

(56) References Cited

U.S. PATENT DOCUMENTS

| | | | | |
|---|---|---|---|---|
| 1,806,238 | A * | 5/1931 | De Mers | G05D 23/12 241/33 |
| 1,843,301 | A * | 2/1932 | Player | B24B 19/12 451/62 |
| 2,553,831 | A | 5/1951 | Musyl | |
| 2,721,424 | A | 10/1955 | Teisen | |
| 4,248,019 | A | 2/1981 | Hawley et al. | |
| 4,461,121 | A | 7/1984 | Motzer et al. | |
| 4,870,784 | A * | 10/1989 | Ramos | B24B 9/148 451/5 |
| 5,163,199 | A | 11/1992 | Saja et al. | |

(Continued)

FOREIGN PATENT DOCUMENTS

| | | | |
|---|---|---|---|
| CH | 667417 A5 * | 10/1988 | B24B 5/01 |
| DE | 3501385 | 8/1985 | |

(Continued)

OTHER PUBLICATIONS

International Preliminary Exam Report for PCT/GB00/02990 completed on May 11, 2011.

(Continued)

*Primary Examiner* — Katina N. Henson

(74) *Attorney, Agent, or Firm* — Reising Ethington P.C.

(57) ABSTRACT

A high efficiency grinding machine for grinding the pin on a crankshaft has a machining space with a grinding wheel mounted on the lower end of an arm to form a pendulum assembly. A headstock supports the crankshaft in the machining space. A pivot drive rocks the pendulum assembly back and forth equal distances about the equilibrium position causing the grinding wheel to follow the non-circular path of a pin as the crankshaft as it is rotated about its elongated axis.

24 Claims, 3 Drawing Sheets

(56) References Cited

U.S. PATENT DOCUMENTS

| | | | | |
|---|---|---|---|---|
| 5,697,831 | A | 12/1997 | Reichel | |
| 6,334,806 | B1 * | 1/2002 | Sano | B24B 5/42 451/249 |
| 9,248,535 | B2 | 2/2016 | Stocker | |
| 9,550,265 | B2 | 1/2017 | Hildebrandt | |
| 9,579,760 | B2 | 2/2017 | Gosebruch | |
| 2003/0094568 | A1 | 5/2003 | Meschko | |
| 2004/0072521 | A1 | 4/2004 | Pflager et al. | |
| 2006/0111020 | A1 | 5/2006 | Clauseen-Markefka | |
| 2013/0045665 | A1 | 2/2013 | Schmitz | |

FOREIGN PATENT DOCUMENTS

| | | | |
|---|---|---|---|
| DE | 102017104591 | A1 | 9/2017 |
| FR | 2545748 | A1 | 11/1984 |
| JP | H05177529 | A | 7/1993 |
| KR | 20170090769 | A | 8/2017 |
| WO | 9748523 | A1 | 12/1997 |
| WO | 0110597 | A1 | 2/2001 |
| WO | 2004080651 | A1 | 9/2004 |

OTHER PUBLICATIONS

International Search Report of PCT/US2018/035950 filed on Jun. 5, 2018, dated Feb. 25, 2019. 2 pages.

* cited by examiner

PENDULUM GRINDING MACHINE

FIELD

The device relates to a crankshaft grinding machine having grinding wheels which are supported by an overhead beam and have a pendulum motion to follow the crankshaft pins as the crankshaft is rotated about its longitudinal axis.

BACKGROUND

In a typical prior art crankshaft grinder, the crankshaft is mounted between a headstock and a tailstock or between two headstocks, with one or more grinding wheels being used to grind the pin bearings on the crankshaft. The grinding wheel is normally mounted on the side of the crankshaft, and because of the orbital motion of the pins relative to the main bearings of the crankshaft, the grinding wheel has to move in and out relative to the crankshaft in order to accurately create the surface of the pin that is being ground. The grinding wheel and the work centerline in these designs exist on a common plane that is essentially horizontal. The grinding wheel spindle is normally supported on a hydrostatic linear bearing so that it can be moved in and out relative to the crankshaft smoothly, and with the least amount of friction. Such a machine arrangement may be called planar or Cartesian.

For reasons of economy, it would be desirable to design a crankshaft grinding machine which requires less floor space than conventional planar or Cartesian crankshaft grinding machines. It would further be desirable to design a high efficiency crankshaft grinding machine that requires less power to move the grinding wheel in and out relative to the crankshaft, and that does not utilize a hydrostatic linear bearing which requires lubrication to support the grinding wheel feed axis.

SUMMARY

An upright crankshaft grinding machine has a smaller footprint than a Cartesian grinding machine and includes an overhead beam which supports a crankshaft and crankpin grinding wheels. Cartesian grinding machines typically use linear hydrostatic bearings positioned below the spindles of the grinding machine. During the machining process, Cartesian grinding machines can create debris in response to creating the surface of a crankshaft. This debris can infiltrate the fluid used by the linear hydrostatic bearing and interfere with optimal operation of bearing. In addition, heat generated during the machining process may impinge on the Cartesian grinding machine hydrostatic bearing, machine base, and other structure thereby changing its geometry and decreasing the precision with which crankshaft surfaces can be created. In contrast, an upright crankshaft grinding machine is not reliant on hydrostatic bearings and can use roller bearings, which are less susceptible to interference from debris due to their location above the working zone. In addition, the upright crankshaft grinding machine suspends grinding wheels from a pivot axis, and are part of a pendulum assembly which has a natural oscillation frequency. Controlling the pendulum assembly to pivot with a pendulum motion back and forth at a natural oscillation frequency reduces the energy required to move the grinding wheels in and out to follow the pins of the rotating crankshaft.

DETAILED DESCRIPTION

Figure 1:
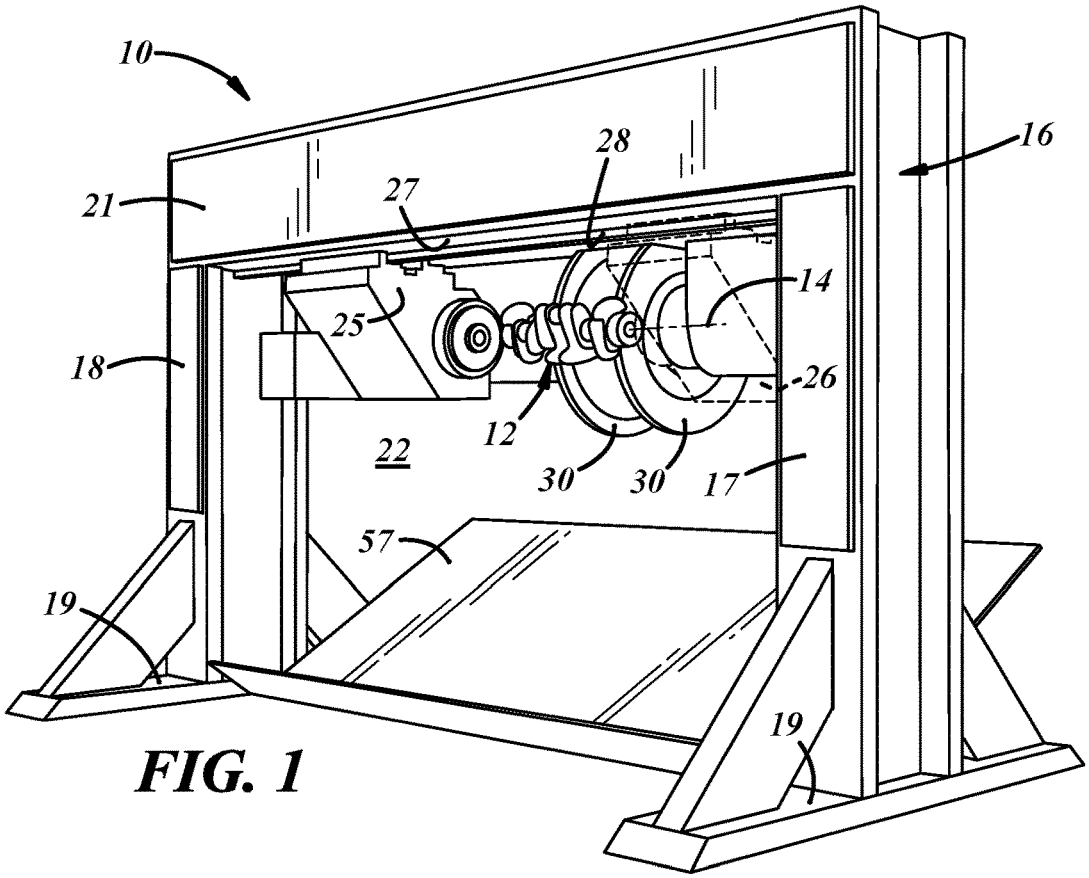
FIG. 1 is a perspective view taken from a first side of a pendulum crankshaft grinding machine.

Turning now to the figures, FIG. 1 is a perspective view taken from a first side of a pendulum crankshaft grinding machine generally designated by the reference numeral 10. The grinding machine is designed for grinding an elongated workpiece 12 which has a workpiece surface that moves in a non-circular path as the workpiece is rotated about its elongated axis 14. Such a workpiece 12 may be a crankshaft or a camshaft. The grinding machine 10 may comprise a rectangular frame 16 having first and second vertical supports 17, 18 which extend upward from a base 19. A horizontal beam 21 joins an upper end of the first vertical support 17 to an upper end of the second vertical support 18. A machining space 22 is formed below the horizontal beam 21 and between the first and second vertical supports 17, 18.

A headstock carriage 25 may be mounted on the horizontal beam 21 in the machining space 22. Headstock carriage ways 27 may run along the length of the horizontal beam 21 and may be used for coupling the headstock carriage 25 to the horizontal beam 21, whereby the position of the headstock carriage 25 along the horizontal beam 21 may be adjusted.

A tailstock carriage 26 may be mounted on the overhead beam 21 in the machining space 22. Tailstock carriage ways 28 may run along the length of the horizontal beam 21 and may be used for coupling the tailstock carriage 26 to the overhead beam, whereby the position of the tailstock carriage 26 along the horizontal beam 21 may be adjusted. The tailstock carriage ways 28 may be extensions of the headstock carriage ways 27, or the headstock and tailstock carriage ways may be independent from one another according to the machine design. A workpiece 12 such as a crankshaft to be ground may be mounted between the headstock carriage 25 and the tailstock carriage 26. Grinding wheels 30 may be positioned in the machining space 22 so that they contact the pins on the crankshaft 12 as described more fully below.

Figure 2:
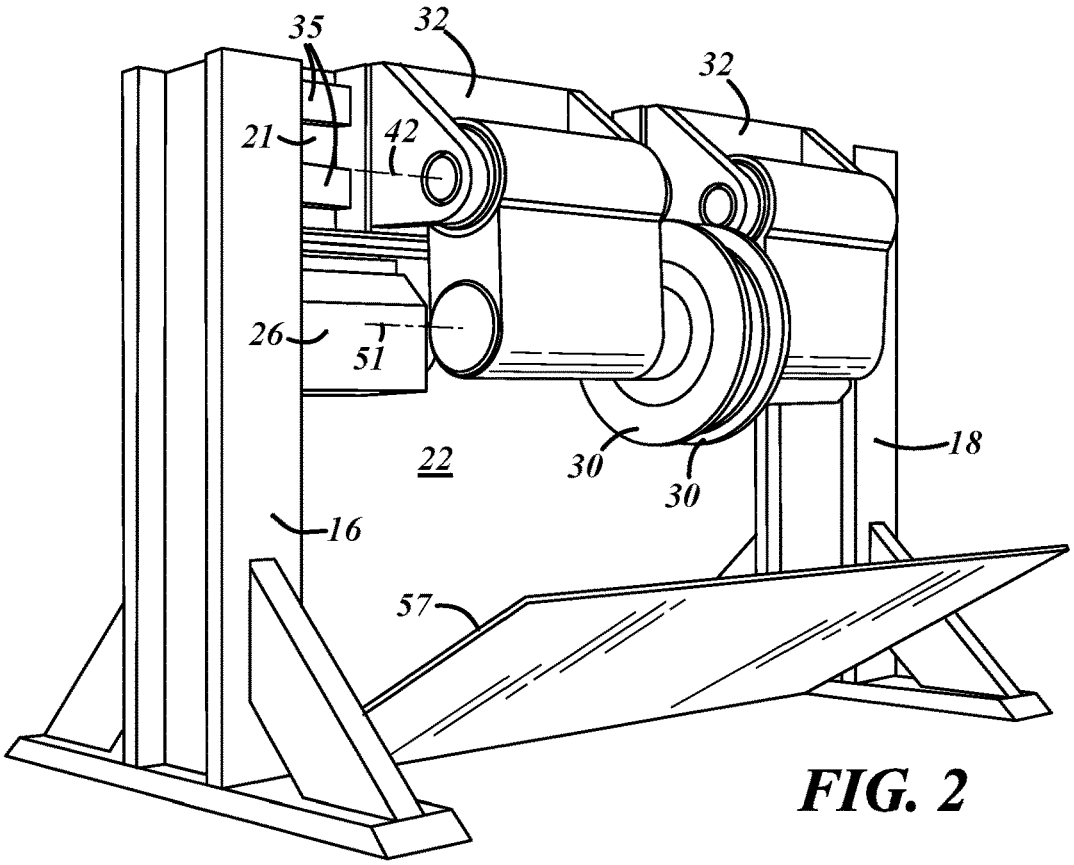
FIG. 2 is a perspective view taken from a second side of the pendulum crankshaft grinding machine of FIG. 1.

FIG. 2 is a perspective view taken from a second side of the pendulum crankshaft grinding machine 10 of FIG. 1 and shows two grinding wheel carriages 32 mounted by ways 35 on the side of the horizontal beam 21. Each grinding wheel carriage 32 supports a grinding wheel 30. Grinding wheel carriage ways 35 may run along the length of the horizontal beam 21 and may be used to couple the grinding wheel carriages 32 to the overhead beam 21. The position of the grinding wheel carriages 32 along the horizontal beam 21 may be adjusted by moving the grinding wheel carriages 32 along the grinding wheel carriage ways 35. The carriages 32 can be moved in the Z-axis using a number of different mechanisms, such as a ball screw or one or more linear motors.

Figure 3:
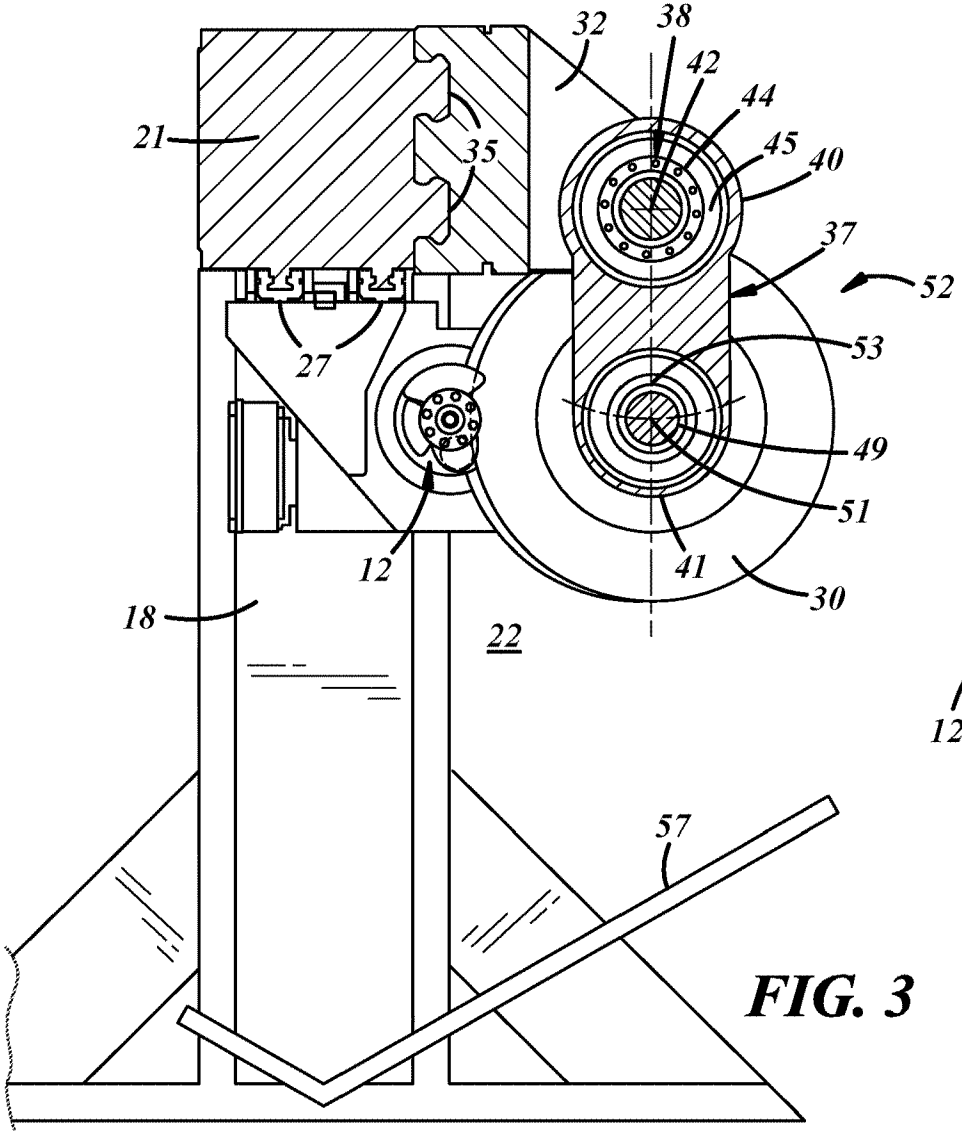
FIG. 3 is an end view partially in section showing a torque motor and encoder used in the pendulum crankshaft grinding machine.

FIG. 3 is an end view partially in section showing an arm 37 and a grinding wheel 30 suspended from the grinding wheel carriage 32. One or more pivot drives 38 may be mounted on each grinding wheel carriage 32. One or more arms 37 may depend from the grinding wheel carriages 32, and each arm 37 has an upper pivot end 40 and a lower end 41. The upper pivot end of the arm 37 is coupled to the pivot drive 38. The pivot drive 38 has a pivot axis 42 that is parallel to the horizontal beam 21, The lower end 41 of the arm 37 may support one or more grinding wheels 30.

The pivot drive 38 may comprise a coaxial torque motor 44 and precision axial encoder 45 positioned in the upper pivot end 40 of the arm 37 which supports the grinding wheel 30. The coaxial torque motor 44 and the precision axial encoder 45 can be incorporated into the upper pivot end 41 such that the rotational output of the motor 44 is coaxial with the pivot axis 42. That is, an output or output shaft of the coaxial torque motor 44 is coaxial to the pivot axis 42. The precision axial encoder 45 can be mounted in relation to the upper pivot end 41 such that it monitors the angular position of the arm 37 as it rotates about the pivot axis 42 in response to the output of the coaxial torque motor 44. In one implementation, the coaxial torque motor 44 can be implemented using a BoschRexroth MBT201C-0010-F torque motor and the precision axial encoder 45 can be implemented using a Heidenhain RCE 8510 encoder. This torque motor can have a 200 Nm peak capability. The particular combination of torque motor and encoder identified above can yield a 1 arc-second accuracy and 32,678 sinewaves per revolution that can further be interpolated by a CNC processor by as much as 32,678 to provide angular resolution of over 1 billion count per revolution ($2^{30}$). If the arm 37 has a length of 250 mm, 1 arc second of accuracy at the pivot axis 42 results in 1.2 μm of error tolerance on a crankpin of the crankshaft.

The coaxial torque motor 44 can be used to rock the arm 37 back and forth allowing the grinding wheel 30 to follow the pin of the crankshaft 12 to create a finished surface moving in an orbital motion around the axis of the crankshaft 12. The precision axial encoder 45 may be used to control the rotation of the torque motor 44 which creates the back and forth rocking of the grinding wheel 30.

A grinding wheel spindle 49 may be mounted on the lower end 41 of the arm 37 and is positioned in the machining space 22. The grinding wheel 30 may be driven by the grinding wheel spindle 49, The grinding wheel 30 has an axis of rotation 51 that is parallel to the horizontal beam 21. The grinding wheel spindle 49, the grinding wheel 30, and the arm 37 forms a pendulum assembly 52 that has a center of mass 53 that is spaced from the pivot axis 42 of the pivot drive 38, The pendulum assembly 52 may be driven to have a pendulum motion at a natural oscillation frequency about its resting or equilibrium position. A pendulum motion is defined by motion of the pendulum an equal distance to either side of the resting or equilibrium position of the pendulum. The natural oscillation frequency of a pendulum is determined by the length of pendulum measured from its pivot axis to the center of mass of the pendulum assembly.

A trough 57 may be positioned at the base of the rectangular frame 16 for catching debris from a machining operation. The trough 57 may be positioned below the elongated workpiece 12 and the grinding wheel 30. By positioning the grinding wheel carriage ways 35 and the headstock and tailstock carriage ways 27, 28 above the elongated workpiece 12, debris from a grinding operation is precluded from falling into and fouling the ways 27, 28, and 35.

Figure 4:
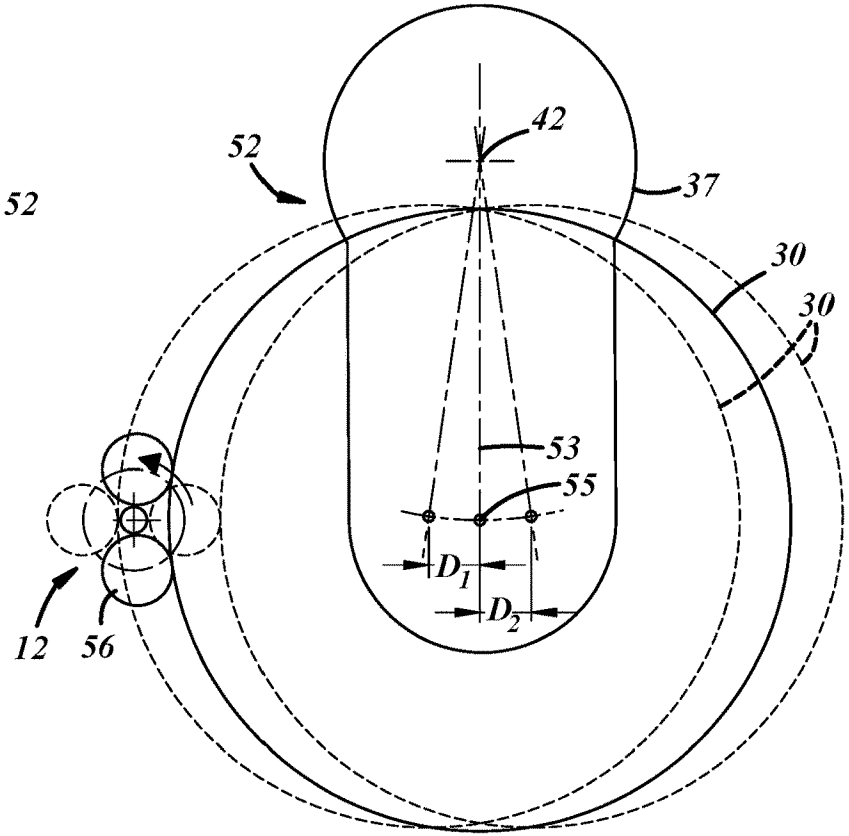
FIG. 4 shows the pendulum assembly swinging back and forth with a pendulum motion.

FIG. 4 shows the pendulum motion of the pendulum assembly 52 about its resting or equilibrium position 55. In order to have a pendulum motion, the pivot drive 38 rocks the grinding wheel 30 back and forth equal angular amounts $D_1$ and $D_2$ in opposite directions from the equilibrium position 55 of the pendulum in the machining space 22 at the natural oscillation frequency of the pendulum assembly 52 to follow the orbital path of a crankshaft pin 56 as the crankshaft 12 is rotated about its elongated axis. $D_1$ and $D_2$ can each equal an angular displacement of the pendulum assembly 52 away from the equilibrium position 55 that can be measured in degrees or radians. The pendulum motion of the pendulum assembly 52 at the natural oscillation frequency creates a pendulum gain. The pendulum motion can follow a shape of a crank rocker four-bar linkage. As a result of the pendulum gain, the overall energy required for the grinding wheel to follow the orbital motion of the crankshaft pin 56 may be reduced by 10 to 20 percent from the overall energy required by a crankshaft grinding machine having a Cartesian geometry with the grinding wheel mounted on a hydrostatic bearing.

In operation, the pivot drive 38 may be used to rock the arm and the grinding wheel 30 back and forth in a controlled manner about the pivot axis 42, to ensure the pendulum assembly 52 is displaced equal angular amounts $D_1$ and $D_2$ in opposite directions from its equilibrium position 55. Rocking the pendulum back and forth in this way minimizes the amount of power required to displace the grinding wheel 30 in order to follow the path of the crankshaft pin 56.

Figure 5:
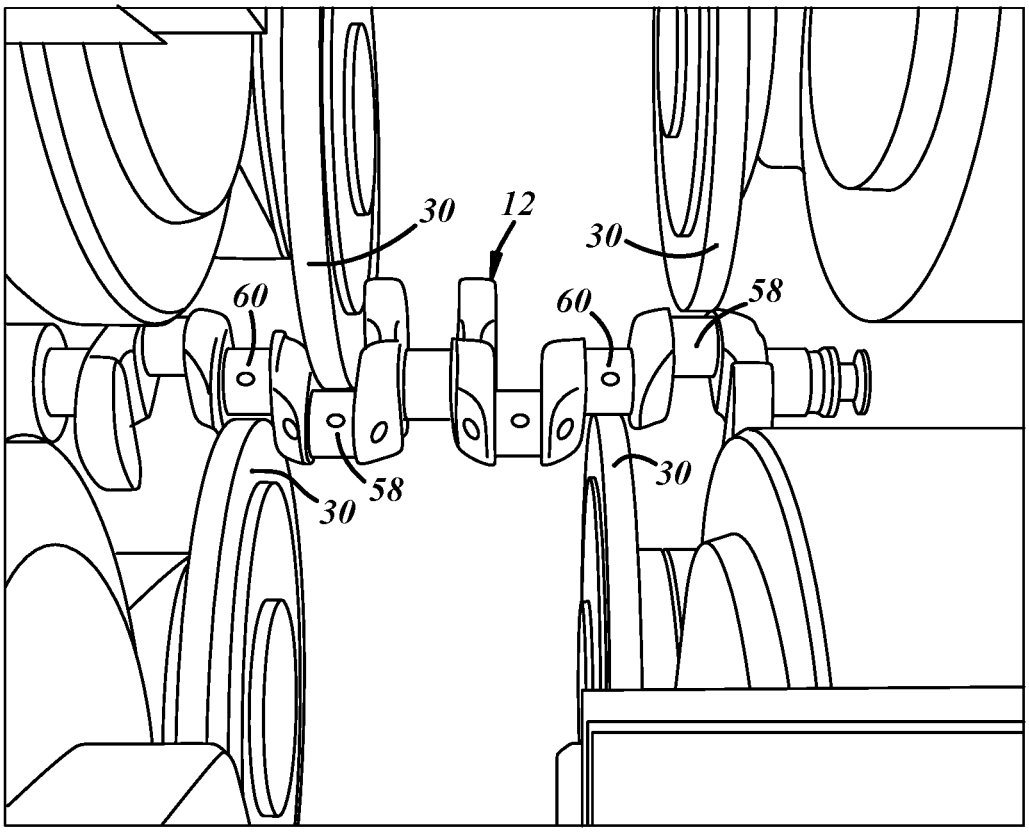
FIG. 5 is a side view of a crankshaft being ground simultaneously by four grinding wheels.

FIG. 5 is a side view of four pins on a crankshaft being ground simultaneously by four grinding wheels 30. The grinding wheels 30 are axially spaced from one another a distance which is equal the distance between pairs of pins allowing pairs of pins to be ground at the same time. One grinding wheel 30 can engage a pin journal 58 while another, separate grinding wheel can engage a main journal 60. Because the position of each of the grinding wheels 30 is controlled by the grinding wheel carriage from which the wheel is suspended, the pin journals 58 and the main journals 60 may be ground at the same time despite existing at different angular positions on the crankshaft 12.

Figure 6:
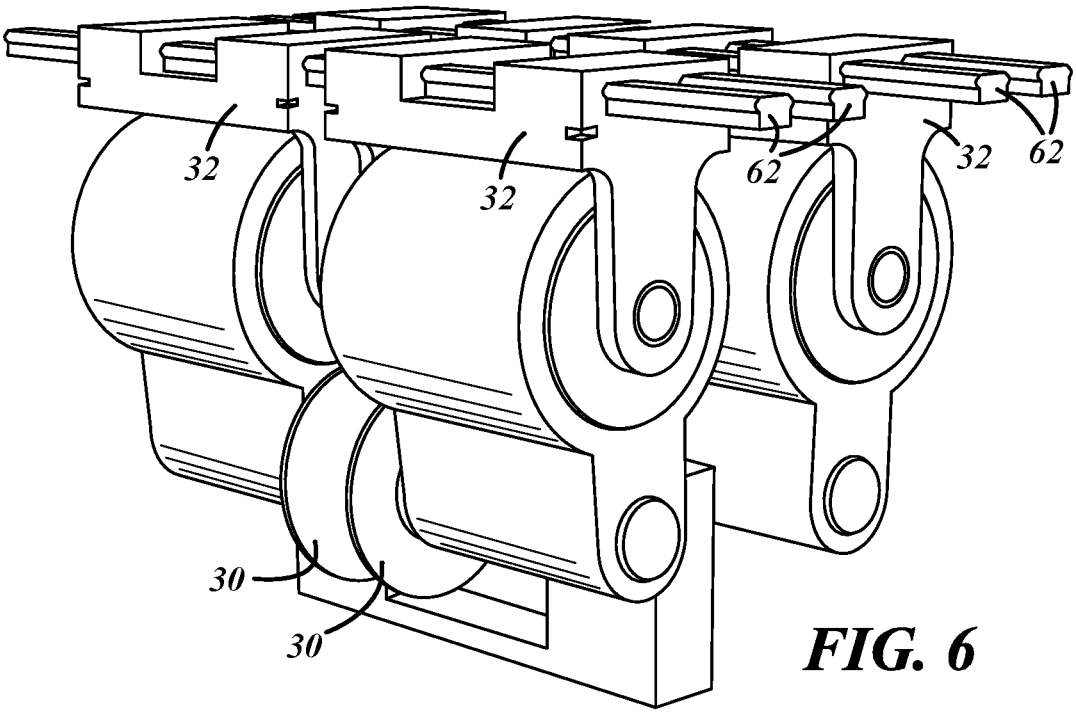
FIG. 6 shows an alternate embodiment in which four pairs of arms support four grinding wheels.

FIG. 6 shows an embodiment in which four grinding wheel carriages 32 (only three are shown) may be mounted on two pairs of rails 62. Each grinding wheel carriage 32 may support a grinding wheel 30 (only two are shown) and this arrangement enables four crankshaft pins to be ground at the same time.

Having thus described the device, various modifications and alterations will occur to those skilled in the art, which modifications and alterations will be within the scope of the appended claims.

The invention claimed is:

1. A high efficiency grinding machine for grinding an elongated workpiece having a first workpiece surface which moves in a non-circular path as the workpiece is rotated about its elongated axis, the grinding machine comprising:

a frame that supports one or more grinding wheel carriages;

a machining space formed below the frame;

at least one grinding wheel carriage mounted on the frame;

at least one pivot drive mounted on the grinding wheel carriage, the at least one pivot drive having a pivot axis;

at least one arm depending from the pivot drive, the at least one arm having an upper pivot end and a lower end;

a grinding wheel mounted on the lower end of the at least one arm and positioned in the machining space, the grinding wheel and the at least one arm having a center of mass that is spaced from the pivot axis, the grinding wheel having an axis of rotation that is parallel to the pivot axis, wherein the at least one arm and the grinding wheel comprises a pendulum assembly having a natural oscillation frequency about an equilibrium position determined by a length of the at least one arm measured from the pivot axis to the center of mass of the pendulum assembly;

wherein the pivot drive rocks the at least one arm and the grinding wheel back and forth in a controlled manner about the pivot axis, whereby the at least one arm and the grinding wheel has a pendulum motion at the natural oscillation frequency as the pendulum assembly is displaced from its equilibrium position; and, a headstock supported by the frame in the machining space, whereby the workpiece may be mounted in the headstock having an axis of rotation that is parallel to the pivot axis, wherein the pivot drive rocks the grinding wheel back and forth equal angular distances about the equilibrium position in the machining space at the natural oscillation frequency of the pendulum assembly to follow the non-circular path of the first workpiece surface as the workpiece is rotated about its elongated axis, and wherein the pendulum motion of the pendulum assembly at the natural oscillation frequency creates a pendulum gain.

2. The grinding machine of claim 1 further comprising:

a grinding wheel spindle mounted on the lower end of the at least one arm, the grinding wheel spindle driving the grinding wheel and being positioned in the machining space.

3. The grinding machine of claim 1 further comprising:

a coaxial torque motor comprising the pivot drive.

4. The grinding machine of claim 1, wherein the frame further comprises a first vertical support and a second vertical support which extend upward from a base and a horizontal beam having a length that joins an upper end of the first vertical support to an upper end of the second vertical support.

5. The grinding machine of claim 1 further comprising:

a crankshaft comprising the workpiece, wherein the first workpiece surface comprises a crankshaft pin.

6. The grinding machine of claim 1 further comprising:

a second grinding wheel carriage mounted on the frame;

at least a second arm having an upper pivot end supported by the second grinding wheel carriage and a lower end;

a second grinding wheel mounted on the lower end of the second arm, the second grinding wheel having an axis of rotation that is parallel to the pivot axis; and, a second pivot drive mounted in the second grinding wheel carriage for rocking the second arm and the second grinding wheel back and forth in the controlled manner, whereby the second arm has a pivoting pendulum motion relative to the second grinding wheel carriage, and whereby a second workpiece surface on the elongated workpiece may be machined at a same time as the first workpiece surface.

7. The grinding machine of claim 3 further comprising:

a precision coaxial encoder coupled to the coaxial torque motor, the precision coaxial encoder controlling the back and forth rocking of the grinding wheel whereby the pendulum assembly has the pendulum motion.

8. The grinding machine of claim 4 further comprising:

a tail stock supported by the horizontal beam in the machining space, the tailstock having an axis of rotation that is coaxial with the axis of rotation of the headstock, whereby the elongated workpiece is supported by the headstock and the tailstock.

9. The grinding machine of claim 4 further comprising:

a headstock carriage supporting the headstock; and, headstock carriage ways running along the length of the horizontal beam and coupling the headstock carriage to the horizontal beam, whereby a position of the headstock carriage along the horizontal beam may be adjusted.

10. The grinding machine of claim 4 further comprising:

grinding wheel carriage ways running along the length of the horizontal beam and coupling the at least one grinding wheel carriage to the horizontal beam, whereby a position of the at least one grinding wheel carriage along the horizontal beam may be adjusted.

11. The grinding machine of claim 4 further comprising:

a trough positioned at the base of the frame for catching debris from a machining operation, wherein the trough is positioned below the elongated workpiece and the grinding wheel, and wherein the grinding wheel carriage ways and the headstock carriage ways are positioned above the elongated workpiece to preclude debris from a grinding operation falling into the grinding wheel and headstock carriage ways.

12. A high efficiency method for grinding an elongated workpiece having a first workpiece surface which moves in a non-circular path as the workpiece is rotated about its elongated axis, the method comprising:

providing a frame that supports one or more grinding wheel carriages; forming a machining space below the frame;

mounting at least one grinding wheel carriage on the frame;

mounting at least one pivot drive on the grinding wheel carriage, the at least one pivot drive having a pivot axis;

depending at least one arm having an upper pivot end and a lower end from the pivot drive;

coupling the upper pivot end of the at least one arm to the pivot drive;

mounting a grinding wheel on the lower end of the at least one arm and positioning the grinding wheel in the machining space, the grinding wheel and the at least one arm having a center of mass that is spaced from the pivot axis, the grinding wheel having an axis of rotation that is parallel to the pivot axis, wherein the at least one arm and the grinding wheel comprises a pendulum assembly having a natural oscillation frequency about an equilibrium position determined by a length of the at least one arm measured from the pivot axis to the center of mass of the pendulum assembly;

using the pivot drive to rock the at least one arm and the grinding wheel back and forth in a controlled manner about the pivot axis, whereby the at least one arm and the grinding wheel has a pendulum motion at said natural oscillation frequency as the pendulum assembly is displaced from its equilibrium position;

supporting a headstock from the frame in the machining space, whereby the workpiece may be mounted in the headstock having an axis of rotation that is parallel to the pivot axis, rocking the grinding wheel back and forth equal angular distances about the equilibrium position in the machining space at the natural oscillation frequency to follow the non-circular path of the first workpiece surface while rotating the workpiece about its elongated axis, wherein the pendulum motion of the pendulum assembly at the natural oscillation frequency creates a pendulum gain.

13. The method of claim 12 further comprising:
mounting a grinding wheel spindle on the lower end of the at least one arm, the grinding wheel spindle driving the grinding wheel and being positioned in the machining space.

14. The method of claim 12 further comprising:
providing a coaxial torque motor to comprise the pivot drive.

15. The method of claim 12 further comprising:
supporting a tailstock from the frame in the machining space, whereby the tailstock has an axis of rotation that is coaxial with the axis of rotation of the headstock, and whereby the elongated workpiece is supported by the headstock and the tailstock.

16. The method of claim 12 further comprising:
supporting the headstock from a headstock carriage; and,
running headstock carriage ways along a length of a horizontal beam and coupling the headstock carriage to the horizontal beam, whereby a position of the headstock carriage along the horizontal beam may be adjusted.

17. The method of claim 12 further comprising:
running grinding wheel carriage ways along a length of a horizontal beam and coupling the at least one grinding wheel carriage to the horizontal beam, whereby a position of the at least one grinding wheel carriage along the horizontal beam may be adjusted.

18. The method of claim 12 further comprising:
positioning a trough at a base of the frame for catching debris from a machining operation, wherein the trough is positioned below the elongated workpiece and the grinding wheel, and wherein the grinding wheel carriage ways and the headstock carriage ways are positioned above the elongated workpiece to preclude debris from a grinding operation falling into the grinding wheel and headstock carriage ways.

19. The method of claim 12 further comprising:
a crankshaft comprising the workpiece, wherein the first workpiece surface comprises a crankshaft pin.

20. The method of claim 12 further comprising:
mounting a second grinding wheel carriage on the frame;
supporting at least a second arm having an upper pivot end from the second grinding wheel carriage and a lower end;
mounting a second grinding wheel on the lower end of the second arm, the second grinding wheel having an axis of rotation that is parallel to a horizontal beam; and, mounting a second pivot drive in the second grinding wheel carriage for rocking the second arm and the second grinding wheel back and forth in the controlled manner, whereby the second arm has a pivoting pendulum motion relative to the second grinding wheel carriage; and, machining a second workpiece surface on the elongated workpiece at a same time as the first workpiece surface is machined.

21. The method of claim 14 further comprising:
coupling a precision coaxial encoder to the coaxial torque motor; and,
controlling the back and forth rocking of the grinding wheel using the precision coaxial encoder whereby the pendulum assembly has the pendulum motion.

22. A high efficiency grinding machine for grinding an elongated workpiece having a first workpiece surface which moves in a non-circular path as the workpiece is rotated about its elongated axis, the grinding machine comprising:
a rectangular frame comprising first and second vertical supports which extend upward from a base and a horizontal beam having a length that joins an upper end of the first vertical support to an upper end of the second vertical support;
a machining space formed below the horizontal beam and between the first and second vertical supports;
at least one grinding wheel carriage mounted on the horizontal beam;
at least one pivot drive mounted on the grinding wheel carriage, the at least one pivot drive includes a coaxial torque motor;
at least one arm depending from the pivot drive, the at least one arm having an upper pivot end and a lower end, wherein the coaxial torque motor has a rotational output that is coaxial with a pivot axis and the upper pivot end rotates about the pivot axis;
a grinding wheel mounted on the lower end of the at least one arm and positioned in the machining space, the grinding wheel and the at least one arm having a center of mass that is spaced from the pivot axis, the grinding wheel having an axis of rotation that is parallel to the horizontal beam; and
a headstock supported by the horizontal beam in the machining space, whereby the workpiece may be mounted in the headstock having an axis of rotation that is parallel to the horizontal beam, wherein the at least one arm and the grinding wheel comprises a pendulum assembly having a natural oscillation frequency about an equilibrium position determined by the length of the at least one arm measured from the pivot axis to the center of mass of the pendulum assembly; wherein the pivot drive rocks the at least one arm and the grinding wheel back and forth in a controlled manner about the pivot axis, whereby the at least one arm and the grinding wheel has a pendulum motion at the natural oscillation frequency as the pendulum assembly is displaced from its equilibrium position; wherein the pivot drive rocks the grinding wheel back and forth equal angular distances about the equilibrium position in the machining space at the natural oscillation frequency of the pendulum assembly to follow the non-circular path of the first workpiece surface as the workpiece is rotated about its elongated axis.

23. The grinding machine of claim 22 further comprising:
a precision axial encoder that is mounted in relation to the upper pivot end such that it monitors an angular position of the arm as it rotates about the pivot axis.

24. The grinding machine of claim 22 further comprising:
a crankshaft comprising the workpiece, wherein the first workpiece surface comprises a crankshaft pin.

* * * * *